US005373794A

United States Patent [19]

Wiberg

[11] Patent Number: 5,373,794

[45] Date of Patent: Dec. 20, 1994

[54] FURNITURE EXTENSION MECHANISM

[76] Inventor: Ole Wiberg, Kirkegade 1, T.V. DE-6700 Esbjerg, Denmark

[21] Appl. No.: 859,700

[22] PCT Filed: Dec. 10, 1990

[86] PCT No.: PCT/EP90/02137

§ 371 Date: Jul. 10, 1992

§ 102(e) Date: Jul. 10, 1992

[87] PCT Pub. No.: WO91/08693

PCT Pub. Date: Jun. 27, 1991

[30] Foreign Application Priority Data

Dec. 11, 1989 [IE] Ireland ..... 3947/89

[51] Int. Cl.[5] ..... A47B 1/04

[52] U.S. Cl. ..... 108/69; 108/115

[58] Field of Search ..... 108/69, 75, 71, 76, 108/79, 78, 72, 73, 74, 115, 132, 129; 248/188.6, 166, 439

[56] References Cited

U.S. PATENT DOCUMENTS

| | | | |
|---|---|---|---|
| 1,009,034 | 11/1911 | Arndt | 108/74 |
| 1,151,733 | 8/1915 | Stein | 108/76 X |
| 1,860,990 | 5/1932 | Burg . | |
| 1,925,216 | 9/1933 | Swartz | 108/69 X |
| 2,755,152 | 7/1956 | Calgy | 108/69 X |
| 2,868,597 | 1/1959 | Morrison | 108/71 |

FOREIGN PATENT DOCUMENTS

| | | | |
|---|---|---|---|
| 414605 | 9/1910 | France . | |
| 2612127 | 9/1988 | France | 108/69 |
| 679449 | 8/1939 | Germany | 108/69 |
| 839080 | 5/1952 | Germany | 108/69 |
| 1593556 | 7/1981 | United Kingdom . | |

*Primary Examiner*—Jose V. Chen

*Attorney, Agent, or Firm*—Klarquist, Sparkman, Campbell, Leigh & Whinston

[57] ABSTRACT

An article of furniture, such as a table, is convertible between a compact usable state and an extended usable state. A movable support surface (4) is extendable from a frame (21, 22). The movable support surface (4) has at least one leg (8) pivotally attached thereto, the leg (8) being ground engagable when the movable support surface (4) is in the extended state and the leg (8) being located out of sight under the frame (21, 22) and under the movable support surface (4) when the movable support surface (4) is in the compact state. Additional support surfaces may be (1) provided so as to be co-planar with the movable support surface (4) when the furniture is extended.

7 Claims, 3 Drawing Sheets

FURNITURE EXTENSION MECHANISM

The present invention relates to extendible furniture such as tables, sofa beds and the like.

It is known to extend furniture such as tables by various means. For example, a table can be enlarged by the addition of an extra wing, either into the middle of the table or at one end thereof. Generally this involves some means by which the frame of the table may be extended. Similarly, items of furniture such as sofa beds and chair beds are known in which the interconversion from sofa to bed is achieved by extending the frame of the sofa.

United Kingdom Patent Specification No. 1 593 556 discloses a convertible sofa bed having a converting mechanism which includes a movable carriage which is supported on a leg when the carriage is extended, which leg is retracted when the carriage is retracted. In the mechanism of the prior-art, the supporting leg is stored in its retracted position against the underside of the carriage and in front of the frame of the chair. This arrangement of the prior-art mechanism suffers from the limitation that the height of the supporting leg is related to the distance from the front of the chair to the chair frame, which distance in turn is limited by the requirement for stability of the chair. Clearly, where the legs of the chair are part of the chair frame, then it is advantageous to position the frame as close as practicable to the outer periphery of the load bearing part of the chair seat, in order to avoid the possibility of the chair toppling when sat on, or in the case of such a mechanism being applied to a table, to avoid tipping over of the table should a user lean on its edge. However, positioning of the frame close to the edge of the chair, and in particular to its forward edge, means that the supporting leg of the extended chair is of necessity short. Such an arrangement is therefore disadvantageous for many designs of sofa bed or chair bed, and due to their longer legs, is even more unsuitable for the extension of tables.

The object of the present invention is to seek to overcome the above disadvantages.

The present invention provides an article of furniture having at least one support surface which is movable to allow the article assume either a compact usable state or an extended usable state, characterised in that the or each support surface has at least one leg pivotally attached thereto, the pivotal leg being ground engagable when the article is in its extended state, the pivotal leg is stored under the movable support surface when the article is in its compact usable state, and means are provided for moving the pivotal leg from its ground engaging mode to its storage mode on movement of the article from its extended state to its compact state.

Preferably, when the article is in the compact usable state, the pivotal leg extends substantially parallel to the support surface.

Advantageously, the means for moving the pivotal leg from its ground engaging mode to its storage mode includes means for lifting the pivotal leg clear of the ground before the pivotal leg begins to pivot into the storage state.

Conveniently, the lifting means comprises means for raising the support surface into a horizontal plane vertically higher than its plane when the article is in either the compact state or the extended state.

In a preferred embodiment, the lifting means comprises a connection between the support surface and the article which permits limited vertical flexible movement between them.

Advantageously, the means for moving the pivotal leg from its ground engaging mode to its storage mode includes a triple pivot arrangement comprising first and second mutually pivotable elements the first element being additionally pivotally attached to the pivotal leg and the second element being additional pivotally attached to the support surface, biasing means for biasing the pivotal leg into the ground engaging mode and an abutment for initiating the pivotal movement of the elements and pivotal leg on engagement of an element against the abutment.

Conveniently, the pivotal leg is locked into its storage mode by engagement of the second element with the abutment.

The invention will now be described more particularly with reference to the accompanying drawings, which show, by way of example only, two embodiments of articles of furniture having an extension mechanism according to the invention.

IN THE DRAWINGS

Figure 1:
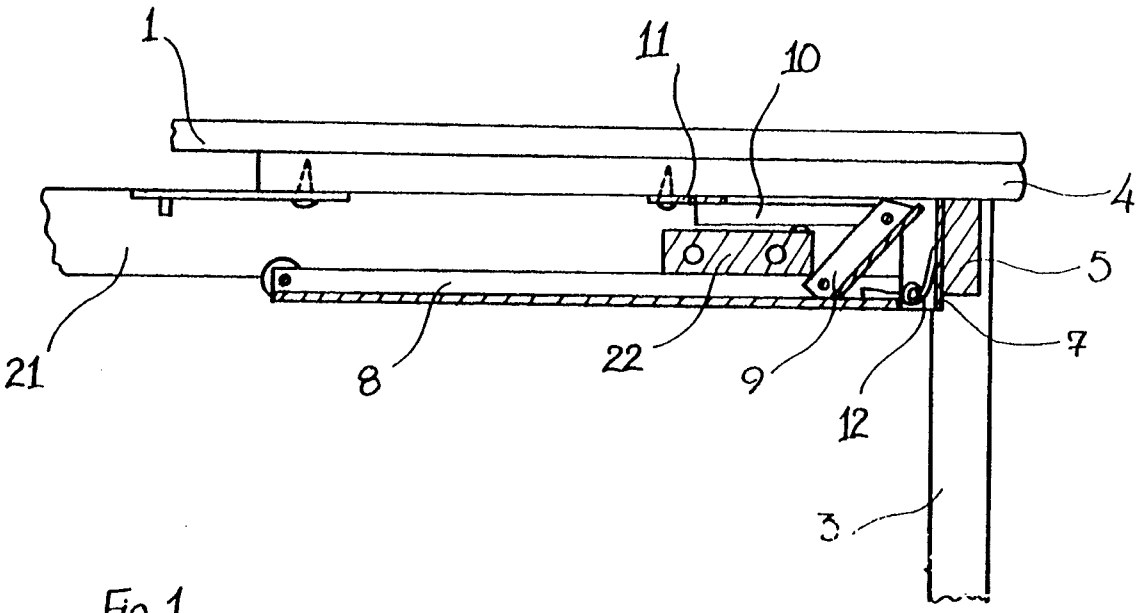
FIG. 1 is a side view of a table with the additional table leaf in the storage position.
Figure 2:
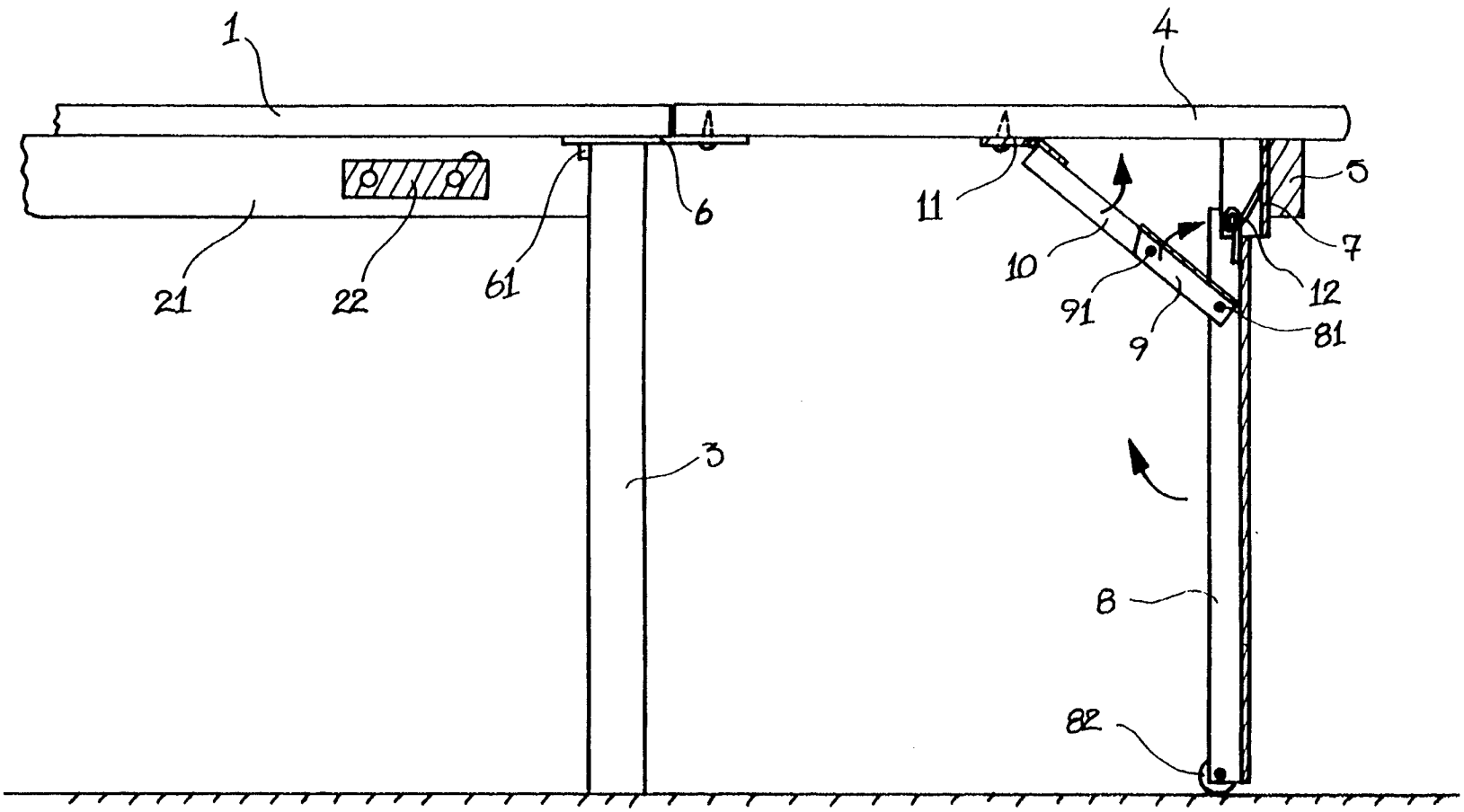
FIG. 2 is a view similar to that of FIG. 1, but with the table extended to bring the additional leaf into use.
Figure 3:
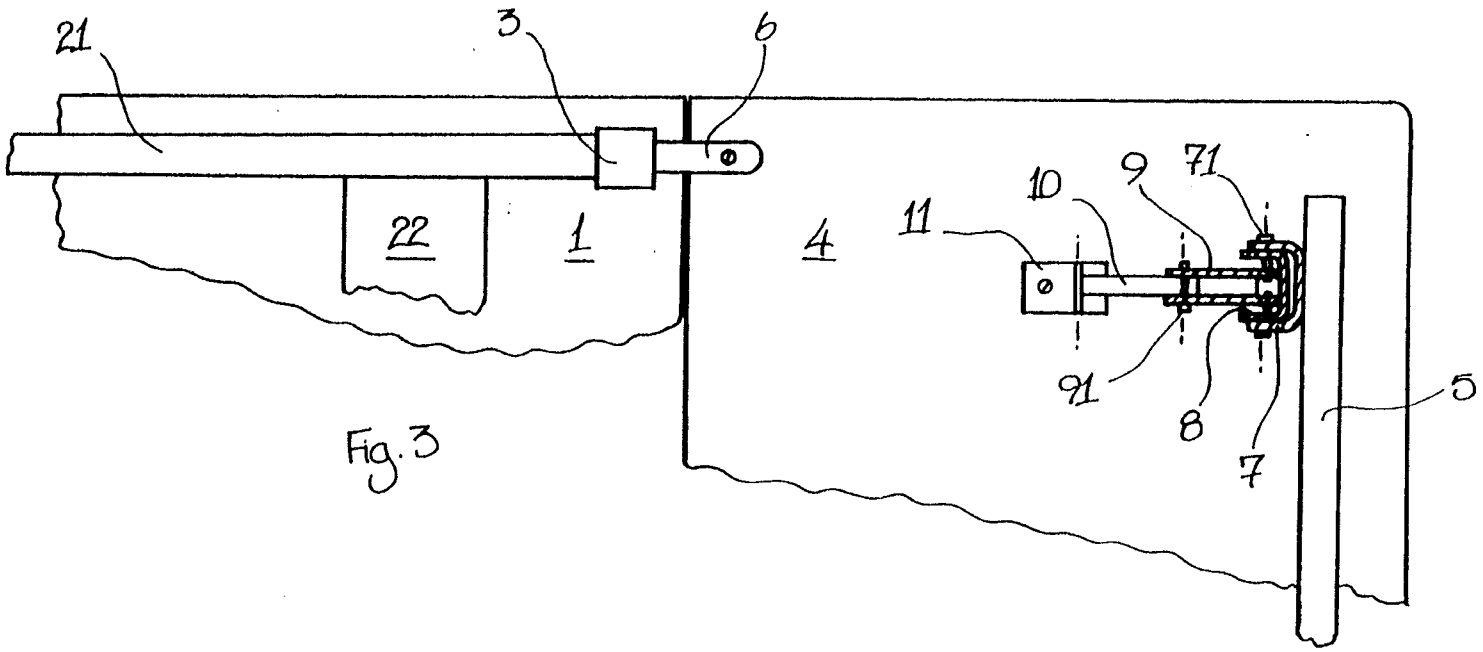
FIG. 3 is a plan view from below of the table with the additional leaf extended.

Referring now to FIGS. 1 to 3, the extension mechanism and its use will now be described.

When in its unextended position, the table comprises a tabletop 1, frame elements 21 and 22 and leg 3. The extra leaf 4 lies under the tabletop 1 and has a frame element 5 attached thereto. The extra leaf 4 is extended by pulling forwardly on the leaf 4 and/or frame element 5 so that the leaf 4 slides out from under the table top 1. The leaf 4 will continue to slide out until the bracket 6, which is attached to the leaf 4, comes into juxtaposition with the leg 3, at which point stop 61 on bracket 6 will engage with the leg 3, thus preventing any further forward movement of the leaf 4. As the leaf 4 slides from underneath it, the tabletop 1 drops so that when the leaf 4 is fully extended, the leaf 4 and tabletop 1 lie end to end, forming a flat surface.

The operation of the mechanism providing a leg as support for the leaf 4 will now be described. As the leaf 4 is pulled out, its supporting leg is simultaneously and automatically brought into position.

The supporting leg comprises a truncated channel section 7, a limb 8, a channel section 9, a rectangular member 10 and a hinge 11. The truncated channel section 7 is attached to the frame element 5 of the leaf 4 and is pivotally connected with the limb 8 by pivot pins 71. The limb 8, which is generally of U-shape in cross-section, is pivotally connected at its upper end with one end of the channel section 9, by means of pivot pins 81. The other end of channel section 9 is in turn pivotally connected with one end of the rectangular member 10, by means of pivot pins 91, while the opposite end of the member 10 is mounted on the hinge 11, which is connected to the leaf 4. The limb 8 may optionally be provided with a castor 82, as shown in FIG. 2.

In the unextended state, the supporting limb 8 lies generally parallel to and beneath the tabletop 1 and beneath the frame elements 21 and 22 of the table. Since the limb 8 is positioned beneath frame element 22, it may extend beyond the element 22, allowing the limb 8 to be of suitable length so as to be able to contact the floor to support the leaf 4 when in the extended position. As the leaf 4 is extended, the limb 8, falling under its own weight, begins to pivot downwardly about pivot pins 81. This action is assisted by spring 12 provided on the section 7, which acts on limb 8. Simultaneously, as limb 8 falls, taking the channel section 9 with it, channel section 9 and the rectangular member 10 pivot with respect to one another about their pivot point and member 10 swings downward on its hinge 11. When the limb 8 reaches its resting point on the floor, the elements of the leg are biased into this final position by the positioning of rectangular member 10 against the inner wall of channel section 9, effectively blocking any further pivoting in either direction.

The table may be readily and easily returned to the unextended position as follows. Firstly, the tabletop 1 is lifted at its end juxtaposing the leaf 4 sufficient to allow the leaf 4 to be accommodated beneath it. The leaf 4, together with its extended supporting limb 8 is then pushed in the direction of the table leg 3. The limb remains extended until the frame element 22 comes into contact with the rectangular member 10. As member 10 hits frame element 22, its forward momentum first causes member 10 to ride up element 22 a short distance, thereby lifting the limb 8 just clear of the ground. At this point the further action of the frame element 22 on rectangular member 10 causes member 10 to pivot with respect to channel section 9. This pivoting movement in turn causes the various elements to pivot in the directions of the arrows in FIG. 2, with the result that the limb 8 swings back up into its storage position. The limb 8 is retained in the storage position by the positioning of rectangular member 10 over the frame element 22 and under the leaf 4.

Thus, in a table according to the invention, extension of the table can be achieved by the one single manipulation of pulling out the extra leaf. The supporting leg for the leaf will automatically extend. Similarly, retraction of the supporting leg when closing the table is automatic.

By varying the length of the member 10, the position of extension at which the pivotal limb 8 may begin to fall under its own weight may be controlled. Thus, in cases where it is desired that the limb 8 should not fall down until clear of, for example, a part of the fixed leg, the element 10 may be correspondingly elongated. In reverse, this will also ensure that the limb 8 will be retracted into its storage position before it can come into contact with the fixed leg.

Figure 4:
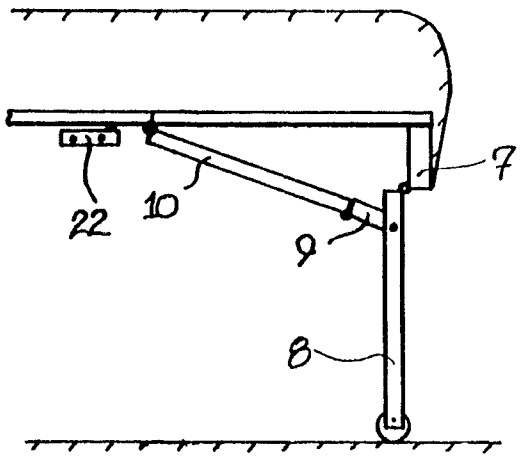
FIG. 4 is a view similar to FIG. 2, but showing a section of a sofa-bed having an extension mechanism according to the invention, in the extended state.

The mechanism described herein can be readily adapted to a sofa bed or chair bed as shown in FIG. 4. Since the supporting limb 8 folds neatly under the frame 22 when the sofa-bed or chair bed is in the compact state, it will be appreciated that the appearance of the item as a piece of living room furniture will be enhanced as the furniture's dual functionality will not be immediately obvious to an onlooker.

The spring 12, which assists in the release of the limb 8 during extension of the furniture, may equally advantageously be positioned between channel section 9 and rectangular member 10, or between member 10 and the leaf 4.

Various alternative embodiments of table having a mechanism of the type described herein are to be considered to be within the scope of the invention. For example, an extending mechanism including the pivotal leg as described above may be provided on either side of the table, so that the surface of the table in its compact state comprises two leaves, joined for example by dowels, each leaf having its own extending mechanism. Each leaf may be provided with a set of rails, one rail being fixed to the table frame and the other rail being slidable in the fixed rail. When the leaves are separated, by extending one or both leaves, by sliding the leaf over its corresponding fixed rail, the space which opens between them may be fitted with one or several additional leaves. In this way a table which is of a size to seat four people when in its compact state, may readily be extended to seat upwards of sixteen persons, depending on the number of additional leaves fitted. A support surface may be provided beneath the principle leaves, for storing the additional leaves when not in use, this surface becoming accessible on separation on the principle leaves.

The pivotal leg may be biased firmly into its ground engaging position by arranging it such that when the furniture is extended, the leg is not vertical but angled so that the bottom of the pivotal leg is horizontally further away from the fixed legs than is the top of the pivotal leg.

The elements of the mechanisms described may be composed of any suitable material, such as for example steel or wood.

What is claimed is:

1. An article of furniture, comprising:

a first frame;

at least one support surface which is movable relative to the first frame to allow the article to assume either a compact usable state or an extended usable state;

at least one leg pivotally attached to the support surface, the pivotal leg being ground engagable when the article is in the extended usable state, and storable in a storage mode under the movable support surface when the article is in the compact usable state; and a frame member supported by the first frame for moving the pivotal leg from a ground engaging mode to the storage mode on movement of the article from the extended state to the compact state by first lifting the pivotal leg clear of the ground before the pivotal leg begins to pivot into the storage state.

2. An article of furniture as claimed in claim 1, wherein when the article is in the compact usable state, the pivotal leg extends substantially parallel to the support surface.

3. An article of furniture as claimed in claims 1 or 2, wherein:

the article further includes a triple pivot arrangement coupling the pivotal leg to the support surface, the arrangement comprising first and second mutually pivotable elements, the first element being additionally pivotally attached to the pivotal leg and the second element being additional pivotally attached to the support surface, and biasing means for biasing the pivotal leg into the ground engaging mode; and the frame member comprises an abutment for initiating the pivotal movement of the first and second elements and the pivotal leg upon engagement of the first and second elements against the abutment.

4. An article of furniture as claimed in claim 3, wherein the pivotal leg is locked into the storage mode by engagement of the second element with the abutment.

5. An article of furniture as claimed in claim 4, further comprising a connection between the support surface and the article which permits limited vertical flexible movement between them.

6. An article of furniture as claimed in claims 4 or 5, wherein:

the mechanism comprises a triple pivot arrangement comprising first and second mutually pivotable elements, the first element being additionally pivotally attached to the pivotal leg and the second element being additional pivotally attached to the support surface, and biasing means for biasing the pivotal leg into the ground engaging mode; and the frame member comprises an abutment for initiating the pivotal movement of the first and second elements and the pivotal leg upon engagement of the first and second elements against the abutment.

7. An article of furniture as claimed in claim 6, wherein the pivotal leg is locked into the storage mode by engagement of the second element with the abutment.

* * * * *